United States Patent [19]

Nakamatsu

[11] 4,215,860

[45] Aug. 5, 1980

[54] GOLFCLUB

[76] Inventor: Yoshiro Nakamatsu, 6-31-10, Shimouma, Setagaya-ku, Tokyo, Japan

[21] Appl. No.: 740,283

[22] Filed: Nov. 9, 1976

[30] Foreign Application Priority Data

May 20, 1976 [JP] Japan ..... 51-57188
Jun. 26, 1976 [JP] Japan ..... 51-74989

[51] Int. Cl.[2] ..... A63B 53/14
[52] U.S. Cl. ..... 273/81 R; 273/81.3
[58] Field of Search ..... 273/77 R, 80 R, 80 C, 273/81 R, 81 B, 81 D, 81.3, 81.4, 162 R, 165; 30/309

[56] References Cited

U.S. PATENT DOCUMENTS

| | | | |
|---|---|---|---|
| 1,506,523 | 8/1924 | Gordon | 273/81 B X |
| 1,587,082 | 6/1926 | Mattern | 273/81 B |
| 1,677,099 | 7/1928 | Harness | 273/81 B |
| 1,919,221 | 7/1933 | Janes | 273/81.3 |
| 2,204,974 | 6/1940 | Strasser | 273/81.3 |
| 2,325,525 | 7/1943 | Lukenbill | 273/81.3 |
| 2,938,728 | 5/1960 | Green | 273/81.3 X |
| 3,219,348 | 11/1965 | Dishner | 273/81 B X |
| 3,376,038 | 4/1968 | Henry | 273/81 R |
| 3,529,826 | 9/1970 | Hulyk | 273/80.2 X |
| 3,881,733 | 5/1975 | Csernits | 273/81 R X |
| 4,067,573 | 1/1978 | Key | 273/81.4 |

FOREIGN PATENT DOCUMENTS

| | | | |
|---|---|---|---|
| 1195916 | 5/1959 | France | 273/81.4 |
| 23514 | of 1907 | United Kingdom | 273/80 C |
| 20882 | of 1908 | United Kingdom | 273/81 B |
| 201621 | 8/1923 | United Kingdom | 273/81 B |

OTHER PUBLICATIONS

"Golf Digest: Putt Better Enterprises", Jun. 1971; p. 124.

*Primary Examiner*—Richard J. Apley
*Attorney, Agent, or Firm*—Jordan and Hamburg

[57] ABSTRACT

A golfclub includes a head and gripping means adapted to be grasped by the right and left hands of a golfer which are disposed side by side to each other in a direction transversely to a plane including the striking face of the head.

1 Claim, 26 Drawing Figures

GOLFCLUB

DETAILED DESCRIPTION

The present invention relates to a novel and unique golfclub.

It is an object of the present invention to provide a novel and unique golfclub by means of which any unskilled golfer can hit the ball with more accurate orientation.

Another object of the present invention is to provide a novel and unique golfclub by means of which any unskilled golfer can play golf without taking unnatural attitudes. A further object of the present invention is to provide a novel and unique golfclub, which is physically safe to the human body avoiding sudden and unnatural distortion to a player's chest thus protecting the ribs from dangerous fracture. Still a further object of the present invention is to provide a novel and unique golfclub which will minimize unfavorable effects to the internal organs of human body, or more particularly prevention of heart attack and hyperpiesia.

The present invention will now be described by way of example with reference to the accompanying drawings, as compared with the conventional golfclub.

Figure 1:
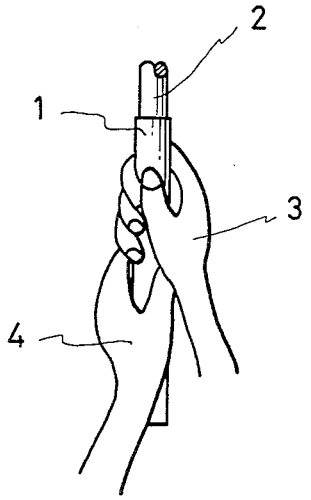
FIG. 1 PRIOR ART
FIG. 1 is a fragmentary view showing the grip portion of a conventional golfclub which is grasped by the right and left hands disposed one after another.
Figure 4:
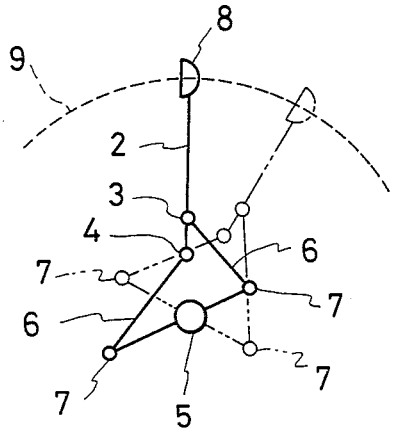
FIG. 4 PRIOR ART
FIG. 4 is a schematic view illustrating a locus of the head in the conventional golfclub.

Prior to the description of the present invention, a conventional golfclub will be described with reference to FIGS. 1 and 4.

In general, the conventional golfclub includes a grip portion 1 of a circular cross-section which is mounted on a shaft 2 of the golfclub. As shown in FIG. 1, a golfer generally grasps the grip portion 1 by his right and left hands 3 and 4 which are positioned one after another along the length of the grip portion 1. In such a grasping condition, the golfer 5 twists his body moving the arms 6 and shoulders 7 from a back-swing position which is indicated by a dotted line in FIG. 4 to an impact position which is indicated by a solid line in the same figure. This movement is apparently unnatural for the human body. It is customary that a golfer hits the ball by circular locus 9 scribed by a head 8 of the conventional golfclub as shown in FIG. 4. By doing so, the angle of the face of head 8 against the direction of the hitting ball changes every moment. In addition to this, because of the circular locus of head 8, the face of head 8 gives a twist, to the ball causing a hook or slice, which will fly or run the ball into an undesired direction. Furthermore, as well known by many golfers, the body of the golfer can be damaged by twisting his body and swinging his arms and shoulders in such an unnatural attitude.

Figure 2:
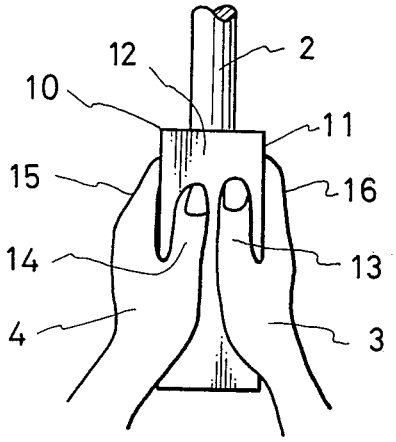
FIG. 2 is a view similar to FIG. 1 showing the grip portion of a golfclub according to the present invention on which the thumbs of the right and left hands are positioned parallel to each other.
Figure 3:
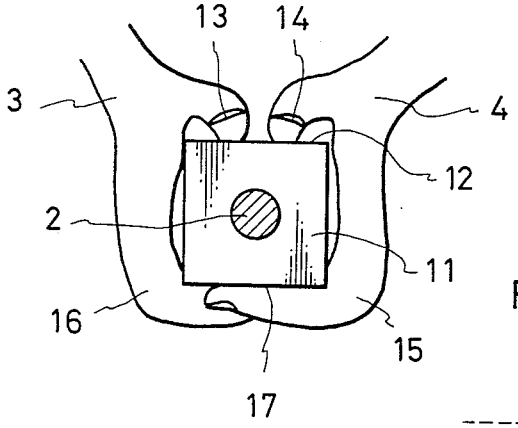
FIG. 3 is an end view of the grip portion in FIG. 2 showing the other fingers of the right and left hands in co-operation with the thumbs thereof.
Figure 9:
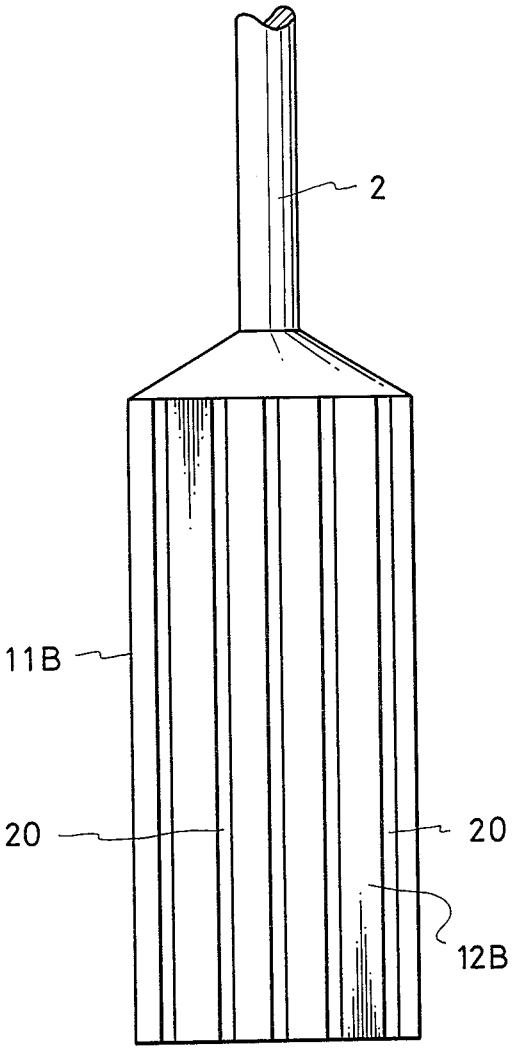
FIG. 9 is a plan view of the grip portion shown in FIG. 7.

In order to overcome these defects in the conventional golfclub, a golfclub according to the present invention includes a grip portion 10 consisting of a gripping member 11 as shown in FIGS. 2, 3 and 9. The gripping member 11 has a square cross-sectional shape which has a top face 12 on which both thumbs 13 and 14 of the right and left hands 3 and 4 of the golfer can be placed parallel to each other. The other fingers 15 and 16 of the hands 3 and 4 are positioned over a bottom face 17 opposite to the top face 12 to grasp the gripping member 11 in cooperation with the thumbs 13 and 14 on the top face 12.

Figure 5:
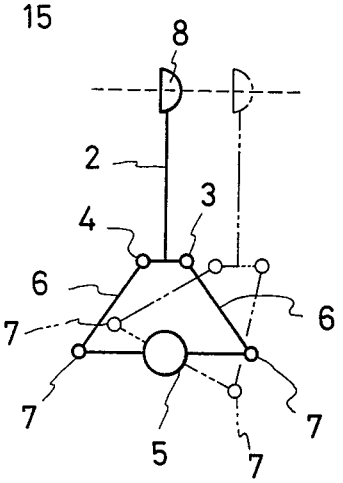
FIG. 5 is a view similar to FIG. 4 illustrating a locus of the head in the golfclub according to the present invention.

A manner in which the golfer swings the golfclub having such grip portion 10 is shown in FIG. 5. The golfer 5 grasps the grip portion 10 by his right and left hands 3 and 4 which are disposed side by side to each other in a direction transversely to a plane including the striking face 8A of the club head 8. Therefore, the golfer 5 will swing the golfclub moving his arms 6 and shoulders 7 from a back-swing position which is indicated by the broken lines in FIG. 5 to an impact position which is indicated by solid lines in the same Figure. This movement of the golfclub does not cause the golfer to take any unnatural attitude. Moreover, during this movement the face of head 8 is kept substantially perpendicular against the direction of the ball, being hit even if the player's body is twisted, because shaft 2 is kept parallel all the time irrespective of the movements of the player's body from the back swing to the follow through. As a result of this the ball is hit straight in a direction perpendicular to the face of the head 8 and thereby flies in the desired direction avoiding a hook or slice.

Figure 6:
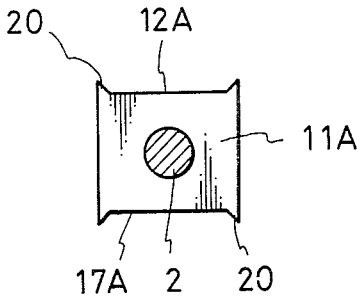
FIG. 6 is a view similar to FIG. 3 showing another configuration of the grip portion according to the present invention.

FIG. 6 shows a modified gripping member 11A having its top and bottom faces 12A and 17A the side edges of which are provided with respective ridges 20 extending along the length thereof. These ridges 20 serves to prevent any slippage of the thumbs 13 and 14.

Figure 7:
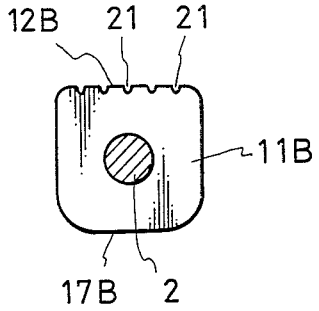
FIG. 7 is a view similar to FIG. 3 showing still another configuration of the grip portion according to the present invention.
Figure 8:
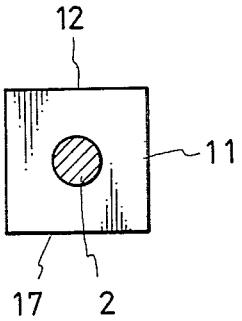
FIG. 8 is a view similar to FIG. 3 showing still a further configuration of the grip portion according to the present invention.

FIG. 7 shows another modified gripping member 11B having its top face 12B which is provided with a plurality of grooves 21 spaced away from each other across the width of the top face 12B and extending longitudinally thereof. The bottom face 17B of the gripping member 11B is rounded at the side edges thereof.

Figure 10:
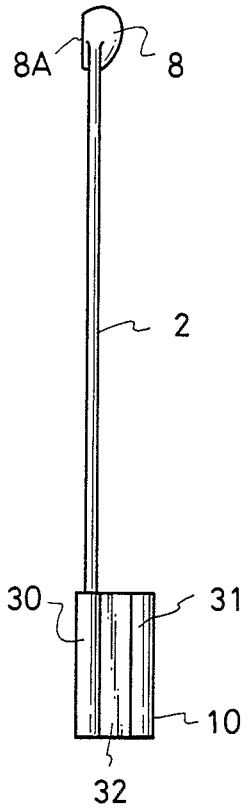
FIG. 10 is a plan view showing a golfclub according to the present invention in which the grip portion includes two gripping members disposed parallel to each other.
Figure 11:
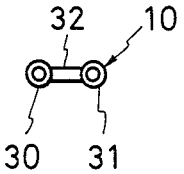
FIG. 11 is an end view of the grip portion in FIG. 10.

Referring to FIGS. 10 and 11, the same parts as in the previous embodiments are indicated by similar reference numerals. A golfclub according to the present invention includes a grip portion 10 which consists of two gripping members 30 and 31 disposed paralled to each other in a plane perpendicularly to a plane including the striking face 8A of the head. The gripping member 30 is mounted directly on the shaft 2 of the golfclub. The gripping member 31 is connected to the gripping member 30 by means of a connecting member 32. The golfer will grasp the grip portion 10 by holding the gripping member 30 with his left hand and the other gripping member 31 with his right hand. The right and left hands will be positioned parallel to each other in a direction transversely to a plane including the striking face 8A of the club head 8.

Figure 12:
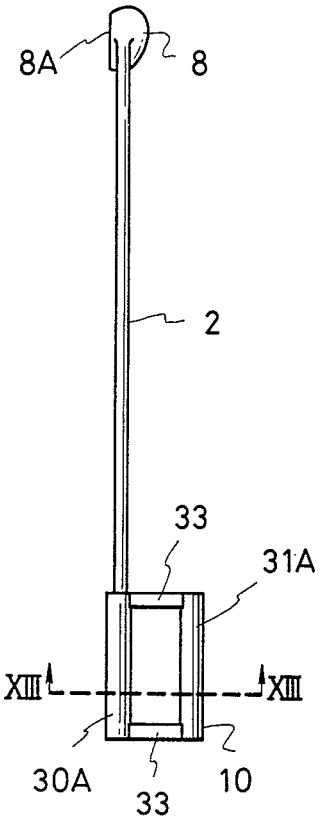
FIG. 12 is a plan view showing a modified embodiment of that shown in FIG. 10.
Figure 13:
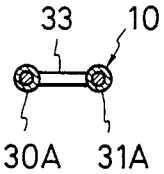
FIG. 13 is an end view of the grip portion shown in FIG. 12.

FIGS. 12 and 13 show a modified grip portion 10 including two gripping members connected at the resective ends with each other by means of two connecting members 33. These members 30A, 31A and 33 define a rectangular-shaped ring with the gripping members being disposed parallel to each other in a plane perpendicularly to a plane including the striking face 8A of the head.

Figure 14:
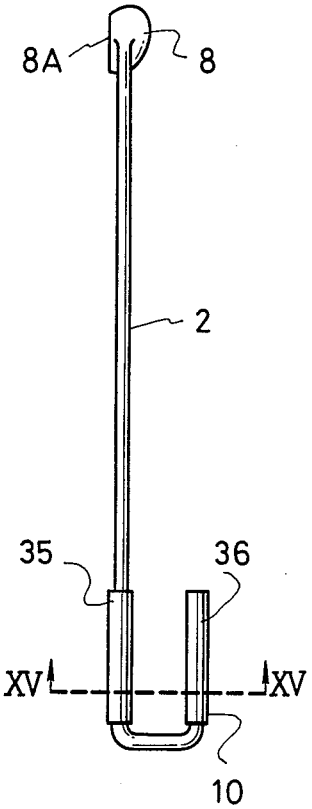
FIG. 14 is a plan view showing another modified embodiment of that shown in FIG. 10.
Figure 15:
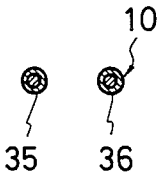
FIG. 15 is an end view of the grip portion shown in FIG. 14.

FIGS. 14 and 15 show another modified embodiment in which the club shaft 2 has its U-shaped end opposite to the head 8. Two gripping members 35 and 36 are mounted on the respective legs of the U, and disposed parallel to each other in a plane perpendicularly to a plane including the striking face 8A of the head 8.

Figure 16:
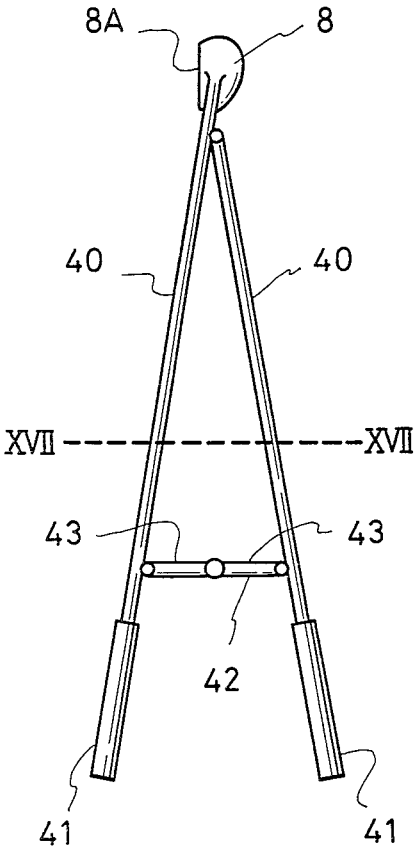
FIG. 16 is a plan view showing a golfclub according to the present invention in which the golfclub includes two club-shafts.
Figure 17:
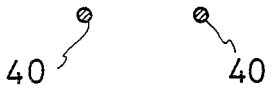
FIG. 17 is cross-sectional view of the shaft 40 taken on line 17—17 of FIG. 16.

A golfclub illustrated in FIGS. 16 and 17 comprises two shafts 40 disposed substantially in a plane perpendicularly to a plane including the striking face 8A of the head 8. Each of the shafts 40 has one end connected to the head 8 with the other end being provided with a gripping member 41 mounted thereon. The shafts 40 diverge in a direction away from the head 8 to form a V-shape.

A hinge member 42 is connected to both of the shafts 40 at a position spaced slightly above the gripping members 41. The hinge member 42 consists of two divided portions 43 each of which is pivotally connected to the respective shaft 40. These hinge portions 43 are also pivotally connected to each other. Therefore, the shafts 40 can be collapsed in a position in which they are disposed parallel to each other in a plane parallel to the plane including the striking face 8A of the head 8 by folding the hinge member 42 when the golfclub is not used.

Figure 18:
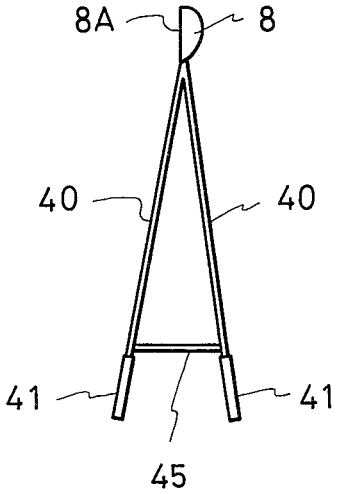
FIG. 18 is a plan view showing a modified embodiment of the golfclub shown in FIGS. 16 and 17.
Figure 18A:
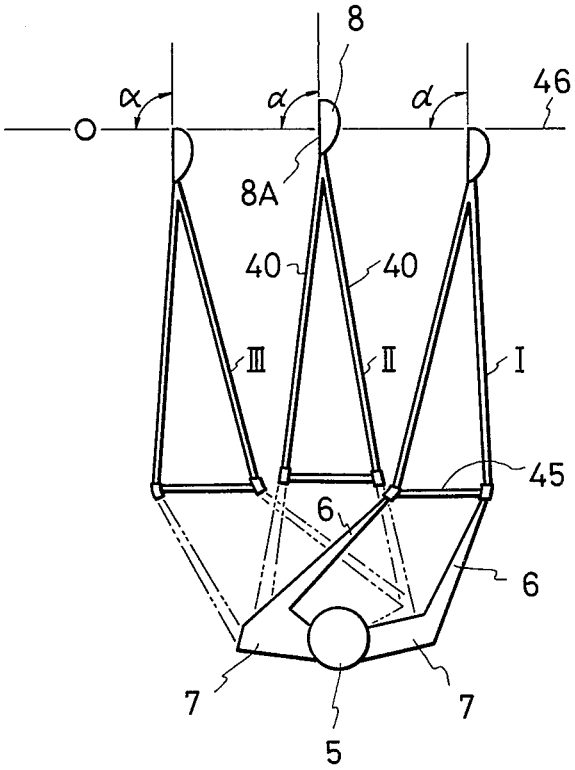
FIG. 18A is a schematic view illustrating a manner in which the gofer hits the ball using the golfclub shown in FIG. 18.

FIG. 18 shows another embodiment in which the same V-shaped shafts 40 are connected to each other by means of an integral connecting rod 45. As seen from FIG. 18A, this golfclub is moved from a back-swing position 1 to a follow-through position 111 via an impact position 11 with the head traveling along a substantial straight line 46. An angle $\alpha$ between the striking face 8A of the head 8 and said substantial straight line 46 is substantially maintained at 90 degrees.

Figure 19:
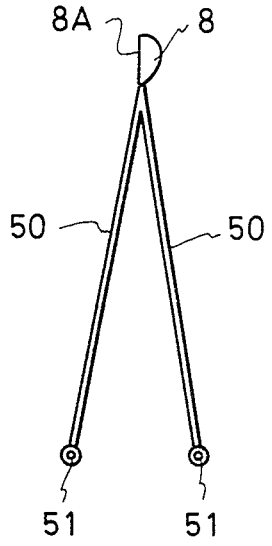
FIG. 19 is a plan view showing another modification of the present invention.
Figure 20:
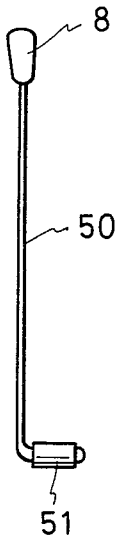
FIG. 20 is a side view of the golfclub in FIG. 19.

FIGS. 19 and 20 show a golfclub according to the present invention without any connecting rod. However, this golfclub includes two shafts 50 forming a V-shape the respective gripping end of which is bent perpendicularly to the plane including the two shafts 50, that is, the plane perpendicularly to the plane including the striking face 8A of the head 8. The bent ends are provided with the respective gripping members 51 mounted thereon. Similarly, the golfer will grasp the club grip by his right and left hands which are positioned side by side to each other in a plane perpendicularly to the plane including the striking face 8A of the club head 8.

Figure 21:
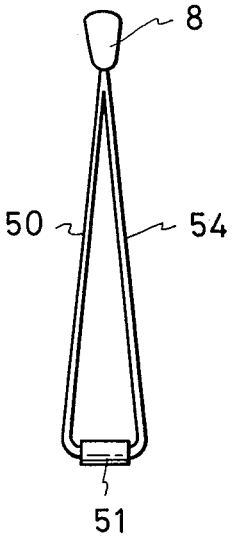
FIG. 21 is a view similar to FIG. 20 showing still another modification of the embodiment in FIG. 20.

In a golfclub illustrated in FIG. 21, two auxiliary shafts 54 connect the head 8 with the respective bent ends disposed perpendicularly to the plane including the main shafts 50 as shown in FIG. 20.

Figure 22:
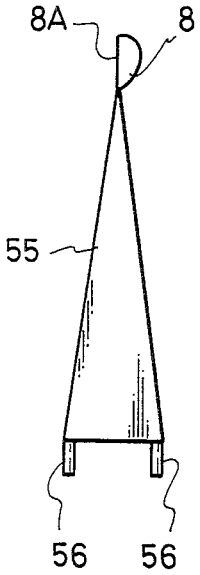
FIG. 22 is a plan view showing a further embodiment of the present invention.

A golfclub shown in FIG. 22 includes a plate-like member 55 instead of a club shaft which is of a triangle shape. At the apex of the head 8 is mounted the striking face 8A which is disposed perpendicularly to a plane including the plate 55. The base of the plate 55 supports two gripping members disposed parallel to each other in the plane including the plate 55.

Figure 23:
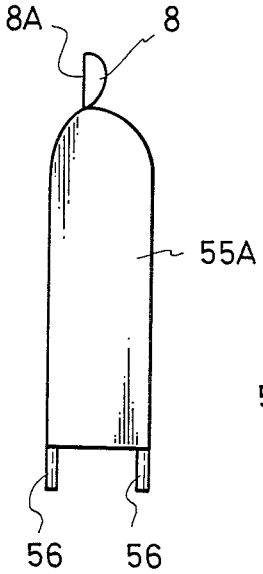
FIG. 23 is a plan view showing still a further embodiment of the present invention.

FIG. 23 shows a modification of the previous embodiment in FIG. 22 in which the plate 55A instead of a shaft is of a substantial rectangular shape.

Figure 24:
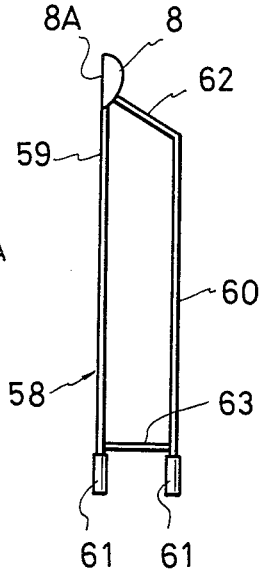
FIG. 24 is a plan view showing still a further embodiment.

FIG. 24 shows a golfclub in which a shaft portion 58 is constructed by two shaft members 59 and 60 and two connecting rods 62 and 63 which form a parallelogram. The head 8 is mounted on the shaft member 59 and the connecting rod 62 at a connection therebetween. The shaft members 59 and 60 have the respective extensions beyond the connecting rod 63 on which gripping members 61 are mounted, respectively. The gripping members 61 are disposed parallel to each other in a plane perpendicularly to the plane including the striking face 8A of the head 8.

Figure 25:
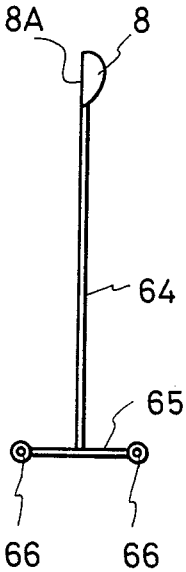
FIG. 25 is a plan view showing a further embodiment of the present invention.

FIG. 25 shows a golfclub in which one shaft 64 supports at its one end the head 8 with the other end thereof being provided with a cross bar 65 mounted on the shaft 64 perpendicularly to the longitudenal axis thereof. Two gripping members 66 are mounted on the cross bar 65 at each end thereof. In the illustrated embodiment, these gripping members 66 are disposed parallel to each other in the respective planes positioned parallel to the plane including the striking face 8A of the head 8. However, the gripping members 66 may be disposed parallel to each other in the plane perpendicularly to the plane including the striking face 8A of the head 8.

While the preferred embodiments of the present invention have been described with reference to the accompanying drawings, many changes and modifications may be accomplished by those skilled in the art without departing the scope and spirit of the invention as defined in appending claims.

I claim:

1. A golf club comprising a head having a striking face for striking a golf ball, a shaft extending from the head, said shaft having an outer surface of circular cross-section, gripping means on the shaft adapted to be gripped by a golfer's hands to swing the golf club, said gripping means consisting essentially of a square cross-section with four mutually perpendicular flat faces including top and bottom faces and two side faces, each of said top, bottom and side faces being parallel to the axis of the shaft and said side faces being generally parallel to the plane of the striking face of said head, said top face being gripped by the golfer's two thumbs such that the two thumbs are disposed side-by-side substantially parallel to one another and parallel to the plane of the striking face of the head, said bottom face being gripped by the other fingers of the golfer's hands transversely to the plane of the striking face and said side faces being engaged by the golfer's palms, whereby the golf club is swingable by a golfer as the golf club including the striking face passes in a direction perpendicular to the plane of the striking face through parallel planes parallel to the striking face at the point of contact of the striking face with the golf ball.

* * * * *